US008407845B2

(12) United States Patent
Yu

(10) Patent No.: US 8,407,845 B2
(45) **Date of Patent: *Apr. 2, 2013**

(54) MOP WITH SPINNING DEVICE

(76) Inventor: Tsung-Mou Yu, Panchiao (TW)

( * ) Notice: Subject to any disclaimer, the term of this patent is extended or adjusted under 35 U.S.C. 154(b) by 331 days.

This patent is subject to a terminal disclaimer.

(21) Appl. No.: 12/861,021

(22) Filed: Aug. 23, 2010

(65) Prior Publication Data

US 2011/0225752 A1 Sep. 22, 2011

(30) Foreign Application Priority Data

Mar. 16, 2010 (TW) ..... 99204607 U

(51) Int. Cl.
*A47L 13/20* (2006.01)

(52) U.S. Cl. ..... 15/119.1; 15/120.1; 15/120.2; 15/228

(58) Field of Classification Search ..... 15/98, 25, 15/119.1, 120.1, 120.2, 229.2, 228; 16/119.1, 16/120.1, 120.2, 229.2, 228; 34/58
See application file for complete search history.

(56) References Cited

U.S. PATENT DOCUMENTS

| | | | | |
|---|---|---|---|---|
| 6,427,280 | B1 * | 8/2002 | Specht | 15/120.2 |
| 8,214,963 | B2 * | 7/2012 | Yu | 15/119.1 |
| 2007/0226929 | A1 * | 10/2007 | Kao | 15/120.1 |
| 2009/0307855 | A1 * | 12/2009 | Kao | 15/3 |
| 2009/0307856 | A1 * | 12/2009 | Fischer et al. | 15/97.1 |
| 2012/0167321 | A1 * | 7/2012 | Lee | 15/119.2 |

* cited by examiner

*Primary Examiner* — Jeanette E. Chapman
(74) *Attorney, Agent, or Firm* — Rabin & Berdo, P.C.

(57) ABSTRACT

A mop including a spinning member, a spiral rod, an extendable rod, a mop head, and a pressing rod is provided. The spinning member includes a first end, a second end opposite to the first end, and a spiral hole axially configured through the spinning member from the first end to the second end of the spinning member. The spiral rod is further provided with a unilateral bearing sleeved over the spiral rod. The spiral rod is sleeved inside the pressing rod. In operation, the mop is put in a basket which is free for rotation and is axially then applied with a downward pressure, and the extendable rod is withdrawn inside the pressing rod. The extendable rod thus synchronously carries the extendable rod, the mop head and the basket to rotate, thus applying a centrifugal force to remove the water content contained in the mop away from the basket.

11 Claims, 10 Drawing Sheets

MOP WITH SPINNING DEVICE

BACKGROUND OF THE INVENTION

1. Field of the Invention

The present invention generally relates to a mop, and in particular to a mop with a spinning device which spins the mop head to remove water by a centrifugal force from the mop head.

2. The Prior Arts

A conventional mop generally includes a mop head, multiple fabric strips connected to the mop head where the fabric strips designed to absorb water are usually made of cotton, sponge, and so on. A shank is usually connected to the mop head so that the user holds the shank and immerses the mop head into water and then squeezes the fabric strips, and in such a way the mop can be used to mop the floor. However, the process of squeezing the fabric strips is inconvenient and requires a large force which is difficult for some users. Some mops are improved to include a clamping device connected thereto and the mop strips can be clamped for removing water content therefrom before using. Unfortunately, such a clamping device of the mop is still inconvenient in use, and the water content is often non-uniformly removed from the fabric strips.

Recently, a product, "mop bucket with wringer", is provided in the market. The structure of the product generally comes up with an outer bucket and an inner bucket configured with many apertures where the mop can be carried to spin. When the fabric strips of a mop absorbs a great amount of water content, the fabric strips are put inside the inner bucket. Then, a power supply is provided or a manual operation is executed to spin the inner bucket relative to the outer bucket. Thus a centrifugal force is applied on the water content and removes some of the water content from the fabric strips. The rest of the water content is remained for mopping the floor.

SUMMARY OF THE INVENTION

A primary objective of the present invention is to provide a mop which has a spinning function without using any extra power supply and the mop head is spun by an axially operation of the shank of the mop so as to remove water from the fabric strips by a centrifugal force.

The present invention provides a mop. The mop includes a spinning member, a spiral rod, an extendable rod, a mop head, and a pressing rod. The spinning member includes a first end, a second end opposite to the first end, and a spiral hole axially configured through the spinning member from the first end to the second end of the spinning member. The spiral rod includes a first end and a second end, and is axially inserted through the spiral hole. The first end and the second end of the spiral rod are opposite each other. The spiral rod is further provided with a unilateral bearing sleeved over the spiral rod. The extendable rod is a hollow member having a first end and a second end. The second end of the extendable rod is tightly coupled with the first end of the spinning member. The mop head is coupled to the first end of the extendable rod. The pressing rod is a hollow member having a first end and a second end. The spiral rod is sleeved inside the pressing rod. The first end of the pressing end is slidably coupled over the spinning member and the extendable rod connected with the spinning member. The second end of the pressing rod is jointed with the second end of the spiral rod.

In operation, the mop is put in a basket. The basket is free for rotation. The pressing rod is axially applied with a downward pressure, and the extendable rod is relatively withdrawn inside the pressing rod. The extendable rod thus drives the spinning member to upwardly spin along the spiral rod, so as to synchronously carry the extendable rod, the mop head and the basket to rotate, thus applying a centrifugal force to remove the water content contained in the mop away from the basket.

According to an embodiment of the present invention, the unilateral bearing is sleeved over the second end of the spiral rod. When the downward pressure is axially applied to the pressing rod to withdraw the pressing rod, restricted by the unilateral bearing, the spiral rod is prevented from rotation, and the spinning member is driven to upwardly displace while rotating along a path of the spiral rod, thus applying a centrifugal force to remove the water content contained in the mop away from the basket.

According to an embodiment of the present invention, the unilateral bearing is provided between the spiral rod and the spinning member. When the downward pressure is axially applied to the pressing rod, the unilateral bearing does not operate. Meanwhile, the spiral rod downwardly displaces, such that the unilateral bearing rotates to upwardly displace, thus carrying the spinning member and the extendable rod to synchronously rotate and upwardly displace. Meanwhile, the spinning member and the extendable rod withdraw inside the pressing rod, thus applying a centrifugal force to remove the water content contained in the mop away from the basket.

Differing from other conventional mops which produce centrifugal force for removing water content by stepping on a pedal mechanism by foot, the present invention is adapted to handle the mop with hand to produce the centrifugal force for removing water content from the mop head.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
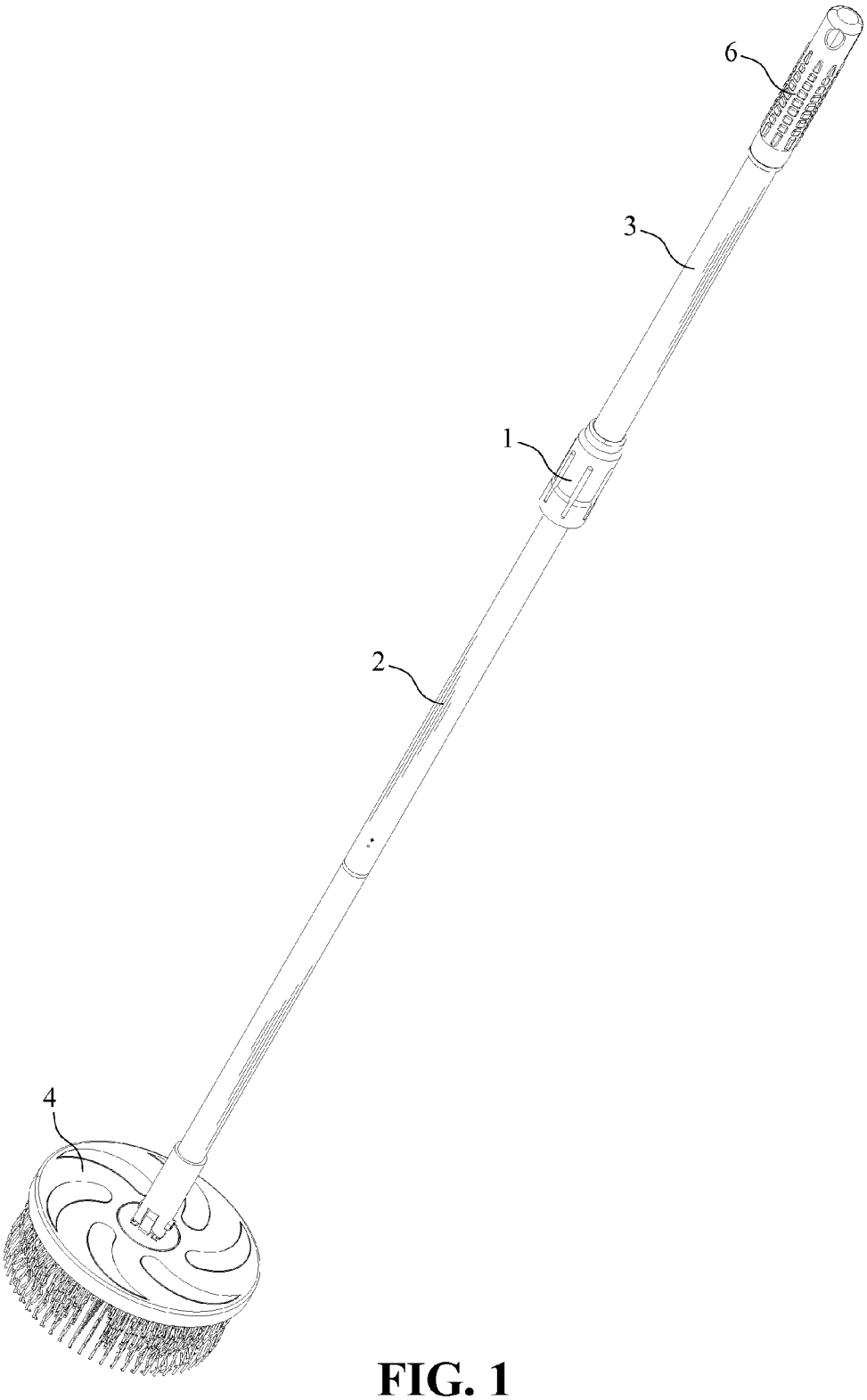
FIG. 1 is a perspective view showing a mop according to a first embodiment of the present invention.

With reference to the drawings and in particular to FIG. 1, a mop in accordance with the present invention is provided.

Figure 3:
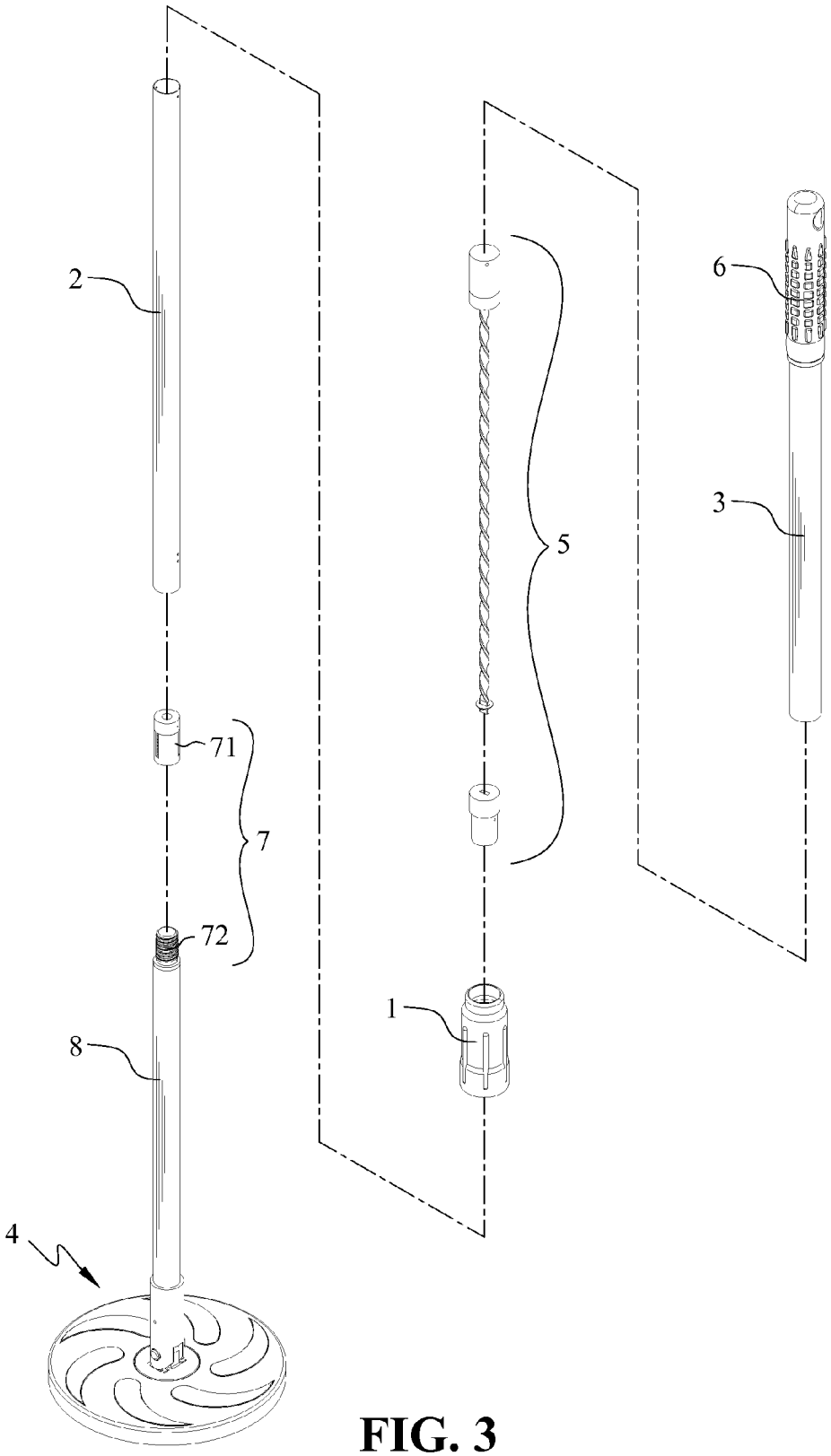
FIG. 3 is another exploded view showing the mop according to the first embodiment of the present invention.

The mop includes a fixing member 1, an extendable rod 2, a pressing rod 3, a mop head 4, and a spinning device (referring to FIG. 3).

Figure 2:
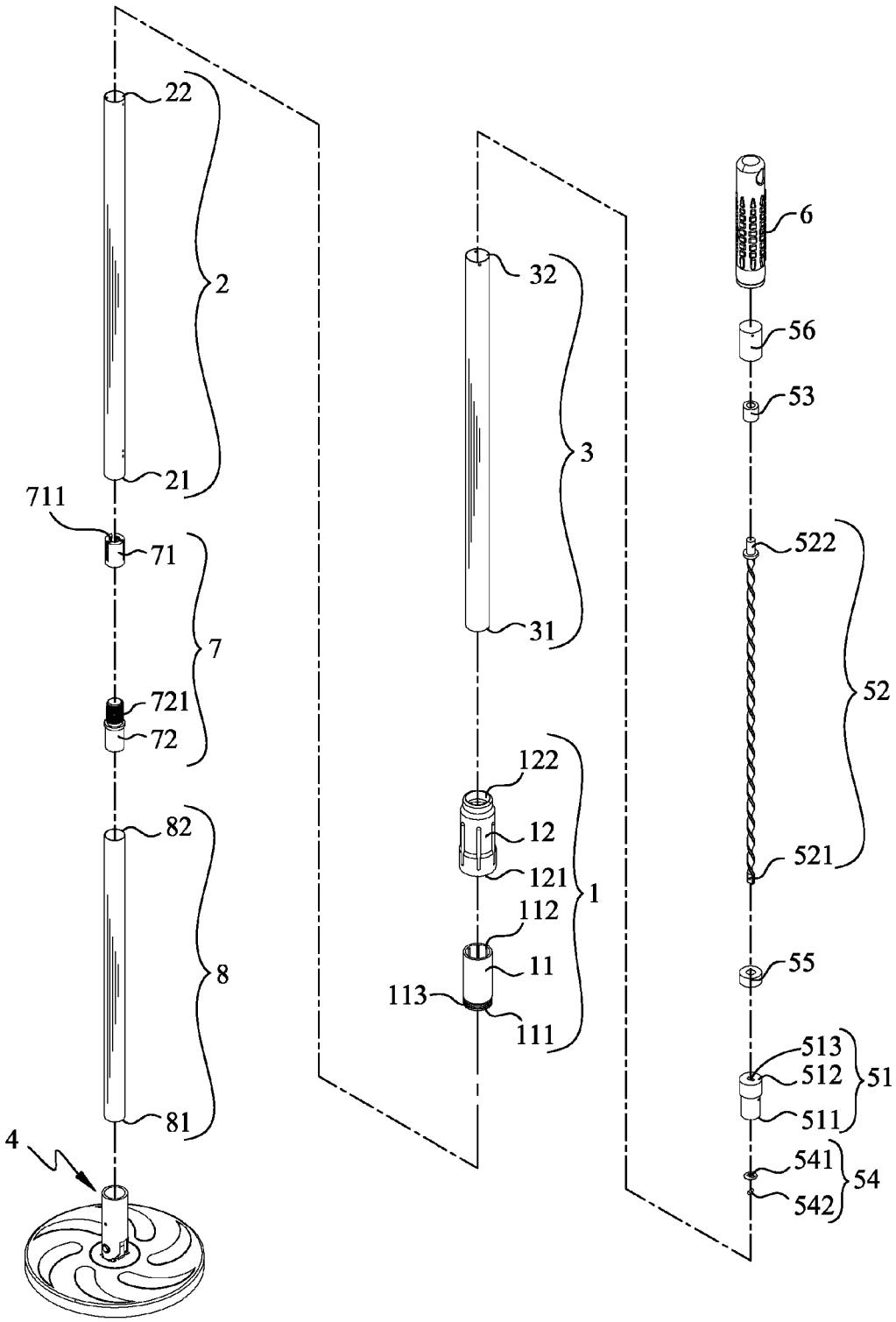
FIG. 2 is an exploded view showing the mop according to the first embodiment of the present invention.
Figure 4:
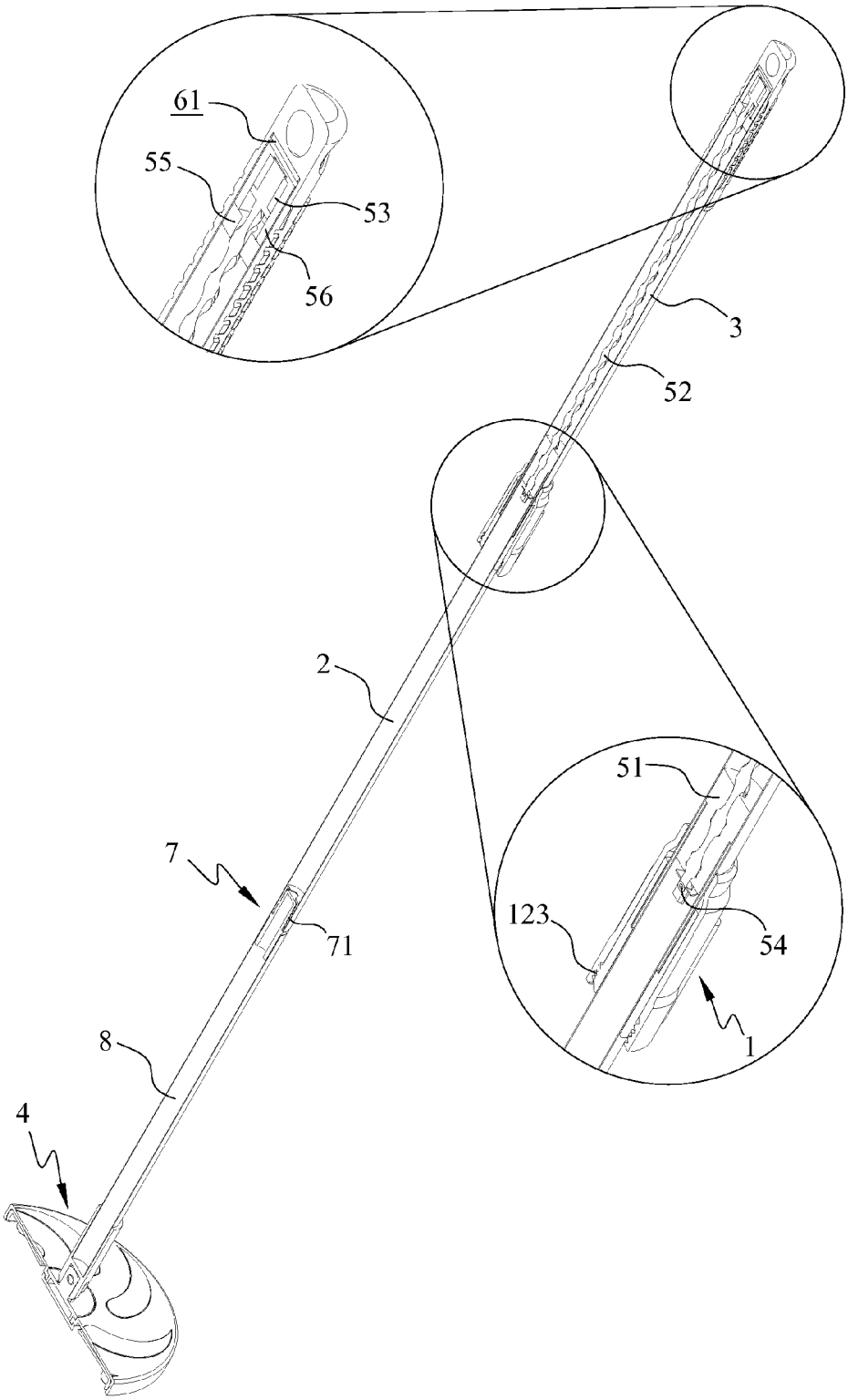
FIG. 4 is a cross sectional view of the mop according to the first embodiment of the present invention.

As shown in FIGS. 2 through 4, the fixing member 1 includes an inner sleeve 11 and an outer sleeve 12. The inner sleeve 11 and the outer sleeve 12 are configured as sleeve members with different sizes. The inner sleeve 11 has a first end 111 and a second end 112. The outer sleeve 12 has a first end 121, and a second end 122. The inner sleeve 11 and the outer sleeve 12 are correspondingly coupled with each other. According to the first embodiment of the present invention as shown in the drawings, a first thread 113 is configured on an outer surface of the first end 111 of the inner sleeve 11, and a second thread 123 is configured on an inner surface of the first end 121 of the outer sleeve 12. The first thread 113 and the second thread 123 are configured in correspondence with each other. The fixing member 1 is adapted for fixing a relative length of the pressing rod and the extendable rod 2. It should be mentioned that in addition to the approach described hereby, the inner sleeve 11 and the outer sleeve 12 can also be coupled by other approaches. For example, corresponding engaging elements can be provided respectively to the inner sleeve 11 and the outer sleeve 12. When the inner sleeve 11 and the outer sleeve 12 are rotated in relative, the engaging elements engage with each other, thus fixing the relative length of the pressing rod and the extendable rod 2.

The spinning device 5 includes a spinning member 51, a spiral rod 52, and a unilateral bearing 53. The spinning member 51 includes a first end 511, a second end 512 opposite to the first end 511, and a spiral hole 513 axially configured through the spinning member 51 from the first end 511 to the second end 512 of the spinning member 51. The spiral rod includes a first end 521 and a second end 522, and is axially inserted through the spiral hole 513. The first end 521 and the second end 522 of the spiral rod 52 are opposite each other. The spiral rod 52 is further provided with a position restricting member 54. The position restricting member 54 includes an annular plate 541 and a pin 542. The annular plate 541 is positioned at the first end 521 of the spiral rod 52 and is positioned beneath the spinning member 51. The pin 542 is radially inserted through the first end 521 of the spiral rod 52 positioned beneath the annular plate 541. The position restricting member 54 is adapted for preventing the spinning member 51 from detaching off the spiral rod 52. A unilateral bearing 53 is sleeved over the second end 522 of the spiral rod 2. The unilateral bearing 53 is adapted for controlling the spiral rod 52 to be capable of rotating toward one direction only. A liner 56 is provided over the unilateral bearing 53.

The pressing rod 3 is a hollow member having a first end 31 and a second end 32. The spinning device 5 is inserted inside the pressing rod 3, such that the spiral rod 52 is positioned parallel with the pressing rod 3, and the second end 512 of the spinning member 51 is fitted in an opening of the first end 31 of the pressing rod 3. The liner 56 and a stopper 55 are tightly coupled with an inner surface of the pressing rod 3. Specifically, the liner 56 is tightly coupled with the opening of the first end 31 of the pressing rod 3, thus enclosing the second end 32 of the pressing rod 3 and preventing the unilateral bearing 53 from detaching off the spiral rod 52. An anti-skidding sock 6 is further provided. The anti-skidding sock 6 is made of plastic material and is configured with anti-skidding pattern on the surface thereof. The anti-skidding sock 6 includes an inner cavity 61 for accommodating the second end 32 of the enclosed pressing rod 3.

The extendable rod 2 is a hollow member having a first end 21 and a second end 22. The extendable rod 2 has a diameter smaller than a diameter of the pressing rod 3. The first end 31 of the pressing rod 3 is inserted through the second end 122 of the outer sleeve 12, and the second end 22 of the extendable rod 2 is inserted from the first end 11 of the inner sleeve 11. The first end 31 of the pressing rod 3 and the second end 22 of the extendable rod 2 are thus jointed with the first end 511 of the spinning member 51 so as to restrict the position restricting member 54 inside the extendable rod 2. As shown in FIG. 4, the pressing rod 3 and the extendable rod 2 configure a longest connection status, in which when the first thread 113 and the second thread coupled to tightly coupling the outer sleeve 12 with the inner sleeve 11, the relative length of the pressing rod 3 and the extendable rod 2 can be fixed.

Further, a connection mechanism 7 is provided at the first end of the extendable rod 2. The connection mechanism 7 includes a lid 71 configured with a tension click structure, and a bolt 72. The lid 71 includes an inner thread 711. The lid 71 is adapted for plugging the opening of the first end 21 of the extendable rod 2. The bolt 72 has a first end configured with an outer thread 721, and a second end. The outer thread 721 is adapted for threadly coupling with the inner thread 711 of the lid 71. An elongation rod 8 is connected to the second end of the bolt 72. The elongation rod 8 is a hollow member having a first end 81 and a second end 82. The second end of the elongation rod 8 is coupled to the bolt 72, and the first end 81 of the elongation rod 8 is coupled to the mop head 4 for elongating the entire length of the mop. The mop head 4 is further provided with mopping members adapted for mopping the floor.

Figure 5:
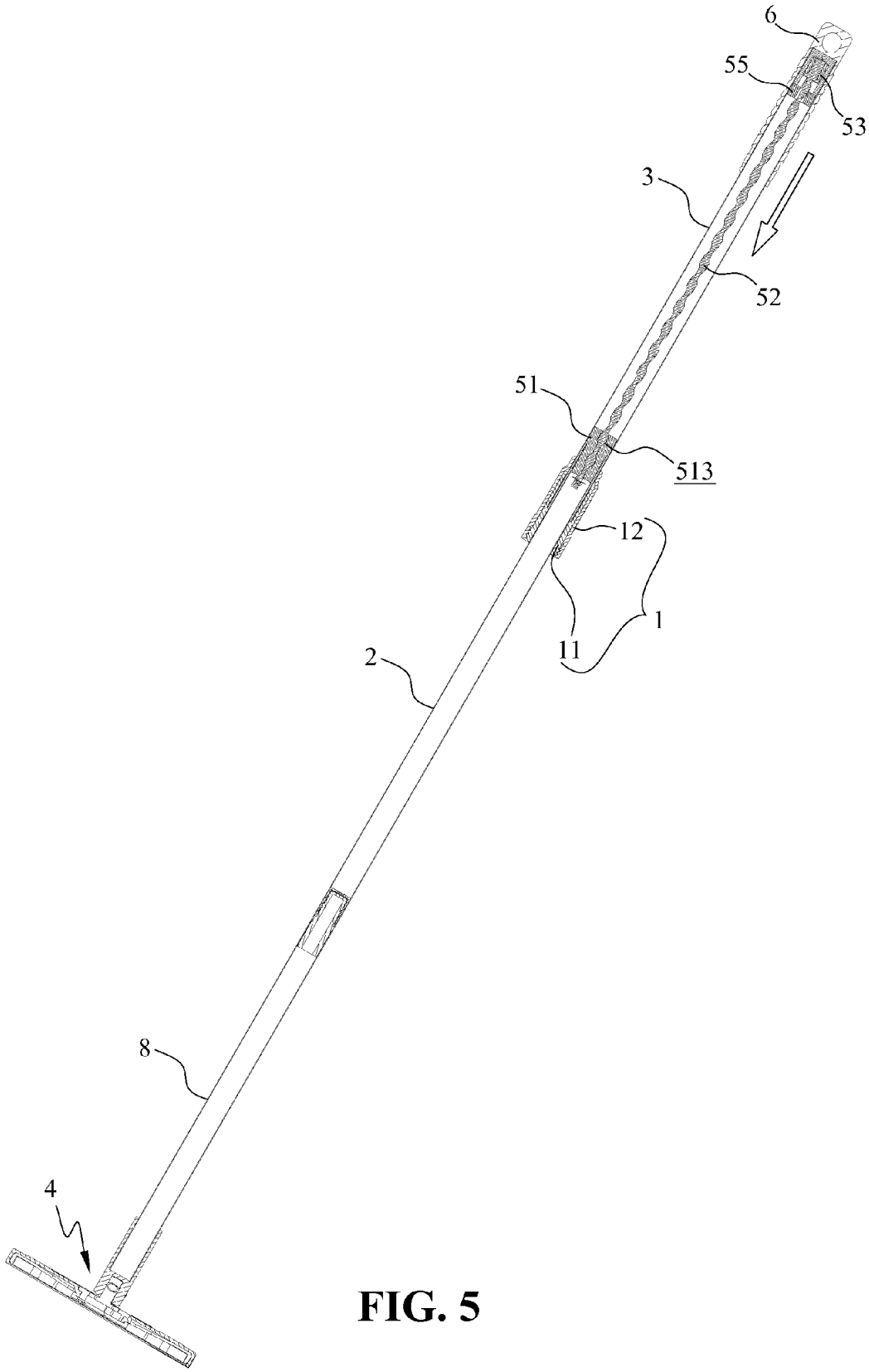
FIG. 5 is a schematic diagram illustrating the operation of pressing down the pressing rod according to the first embodiment of the present invention.
Figure 6:
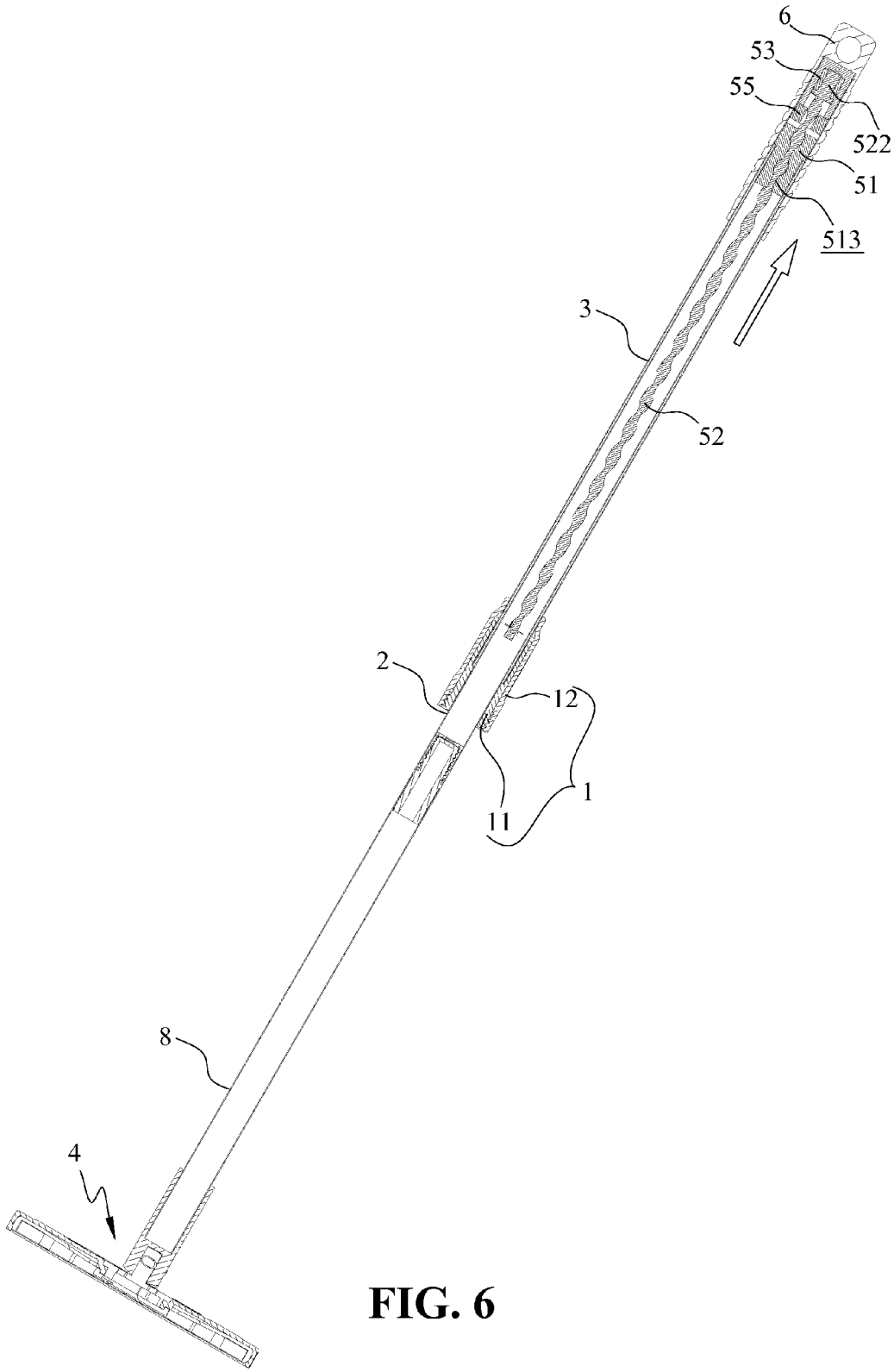
FIG. 6 is a schematic diagram illustrating the operation of pulling up the pressing rod according to the first embodiment of the present invention.
Figure 7:
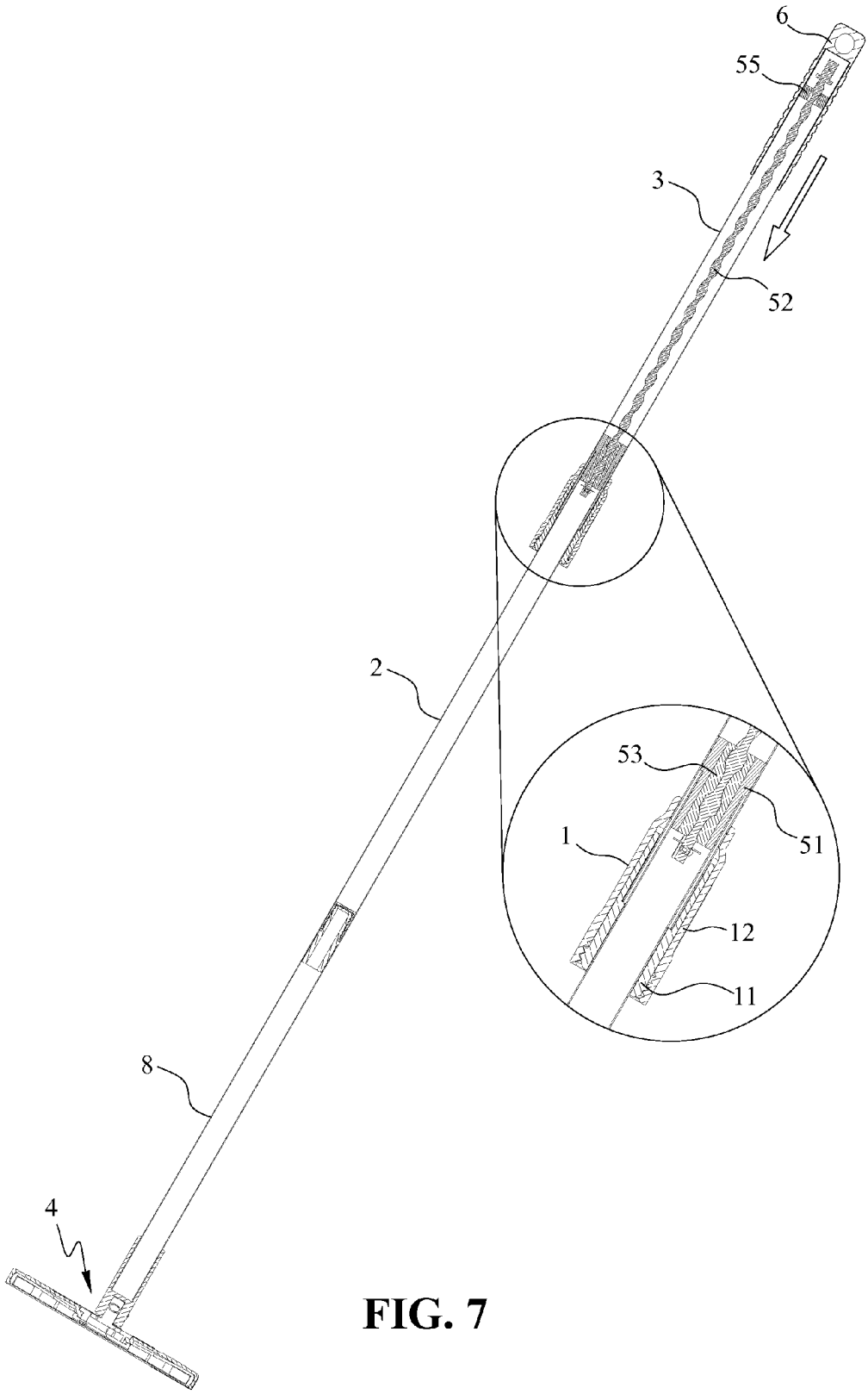
FIG. 7 is a schematic diagram illustrating the operation of pressing down the pressing rod according to a second embodiment of the present invention.
Figure 8:
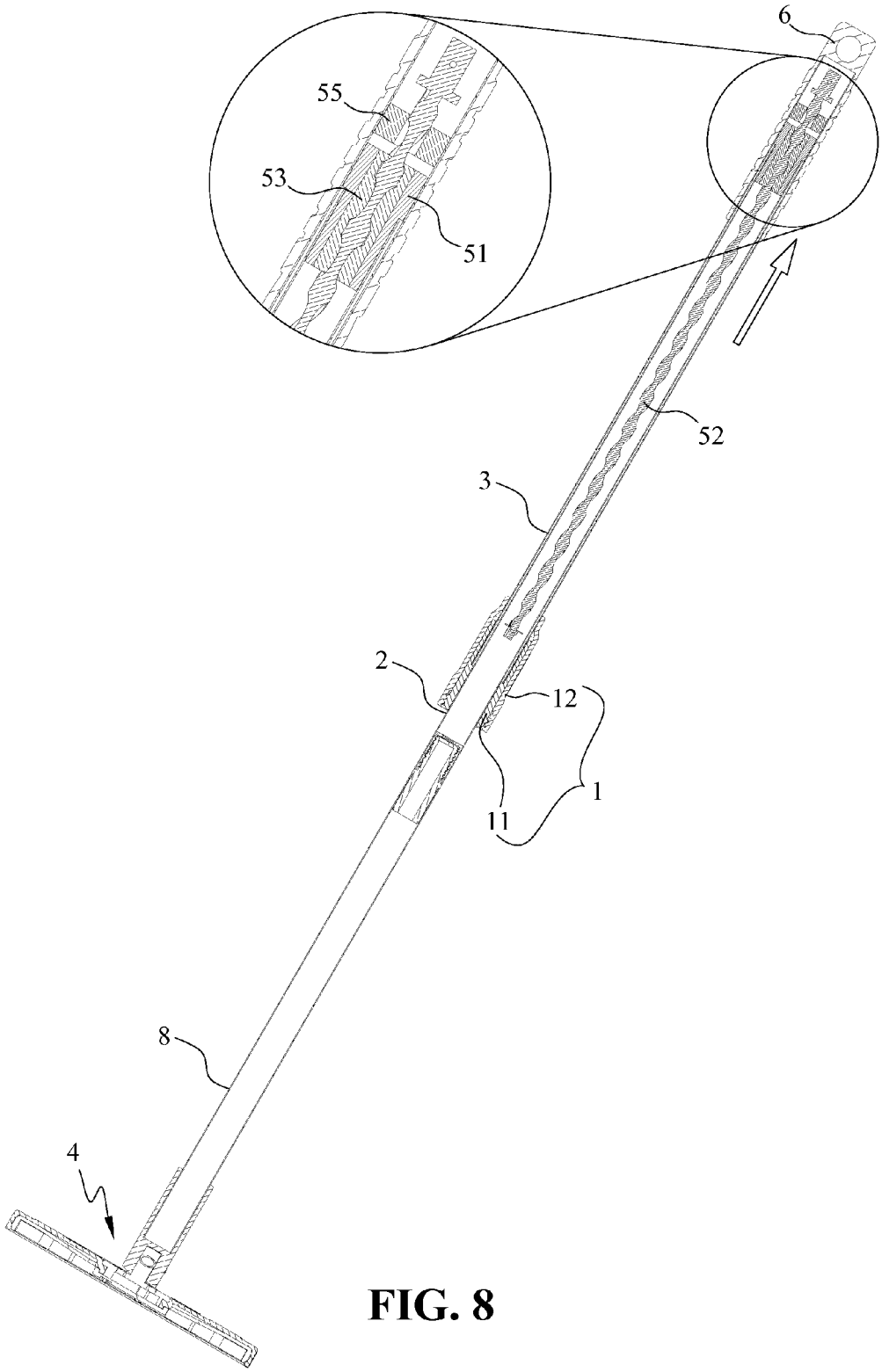
FIG. 8 is a schematic diagram illustrating the operation of pulling up the pressing rod according to the second embodiment of the present invention.
Figure 9A:
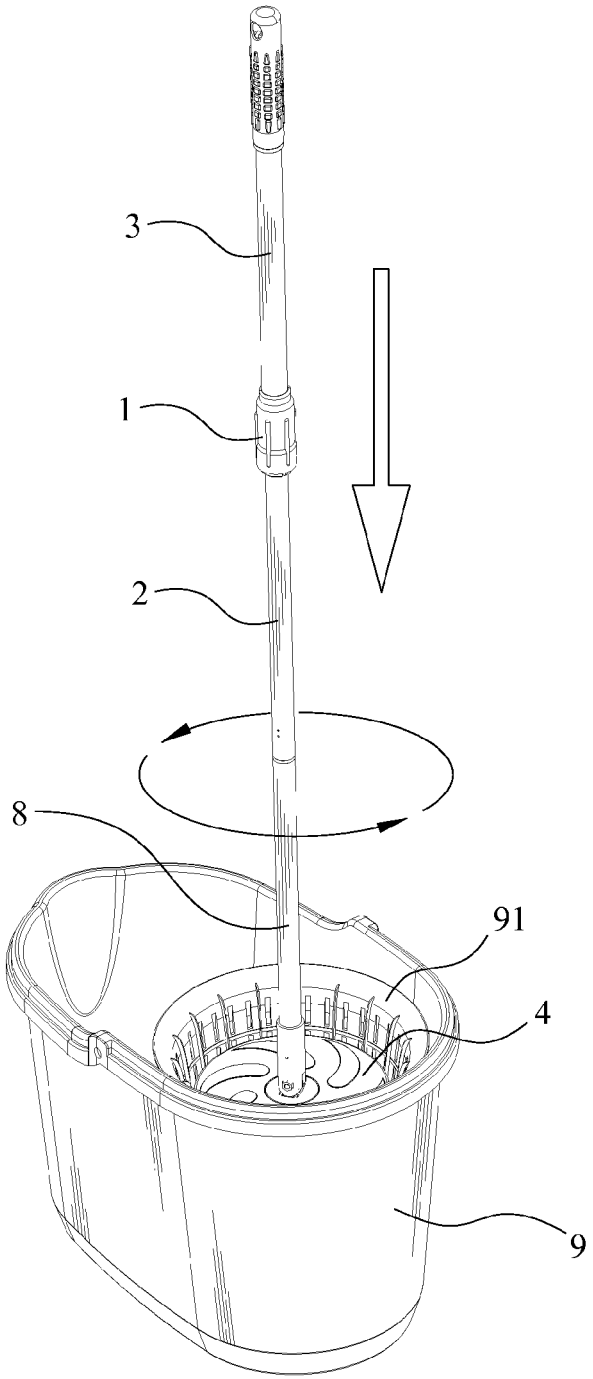
FIG. 9A illustrates the operation of putting the mop head inside a basket and pressing down the pressing rod.
Figure 9B:
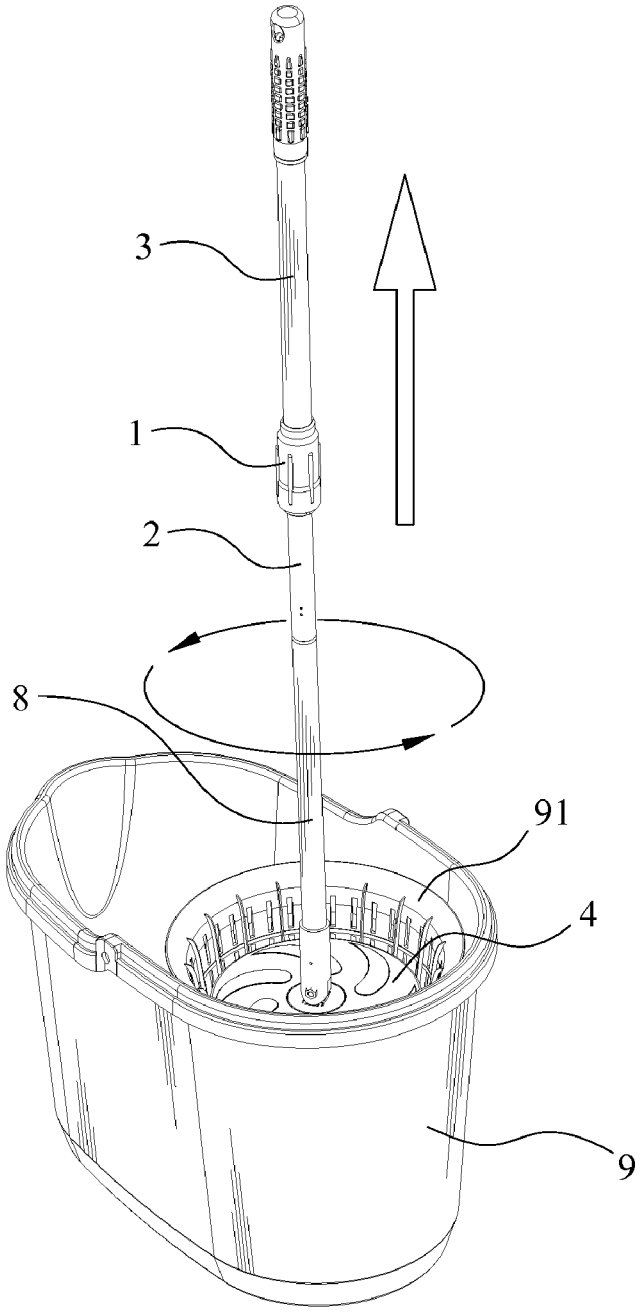
FIG. 9B illustrates the operation of putting the mop head inside a basket and pulling up the pressing rod.

Referring to FIGS. 5, 6, 9A and 9B, there are shown the operation status of the mop according to the first embodiment or second embodiment of the present invention. As shown in FIG. 5, the mop is in an elongation status and fixed thereby, and in this status, the mop can be used to mop the floor. In operation, a container 9 is prepared. The container 9 includes a basket 91 which is free for rotation. The container 9 contains water. When the user intends to flush the mop, the mop head 4 is put in the basket 91. Then, the inner sleeve 11 and the outer sleeve 12 are relatively rotated to loose the connection therebetween. Then, the pressing rod 3 is axially applied with a downward pressure. The mop head 4 is restricted against the basket 91, and thus a counter force is applied to the mop, such that the extendable rod 2 is withdrawn inside the pressing rod 3. Meanwhile, the spinning member 51 is driven to upwardly displace toward the anti-skidding sock 6 along a path of the spiral rod. Restricted by the unilateral bearing 53, the spiral rod 52 does not rotate. As such, the spinning member 51 is forced to rotate while displacing. When the spinning member 51 rotates, the extendable rod 2, the elongation rod 8 connected to the extendable rod 2, the mop head 4, and the basket 91 are synchronously rotated together and produce a centrifugal force. The centrifugal force is applied to remove the water content contained in the mopping members of the mop. The removed water content is thus collected into the container 9.

When the pressing rod 3 is axially pulled upward, because the diameter of the stopper 55 is greater than the diameter of the second end 522 of the spiral rod 52, and the stopper 55 is tightly coupled with the inner surface of the spiral rod 52, the spiral rod 52 is driven to synchronously upwardly move together with the pressing rod. Because of the spiral rod 52 is threadly coupled with the spiral hole 513, the unilateral bearing 53 does not function, so that the spiral rod rotates toward a certain direction, and correspondingly the spinning member 51 axially displaces downwardly to recover its position without driving the mop head 4 to rotate. When the pressing rod is pressed down again, the mop head 4 rotates again. In such a manner, the operation can be repeated for removing the water content from the mopping members to a desired moisture for mopping the floor.

Referring to FIGS. 7, 8, 9A and 9B, there is shown a second embodiment of the present invention. The second embodiment differs from the first embodiment in that the unilateral bearing 53 is positioned between the spinning member 51 and the spiral rod 52. According to the second embodiment, when the mop is in an elongation status and fixed thereby, the mop can be used to mop the floor.

In operation, a container 9 is prepared. The container 9 includes a basket 91 which is free for rotation. The container 9 contains water. When the user intends to flush the mop, the mop head 4 is put in the basket 91. Then, the inner sleeve 11 and the outer sleeve 12 are relatively rotated to loose the connection therebetween. Then, the pressing rod 3 is axially applied with a downward pressure, and correspondingly the extendable rod 2 is withdrawn inside the pressing rod 3. Meanwhile, because the unilateral bearing 53 does not function, so that the unilateral bearing 53 rotates to upwardly displace along the spiral rod 52 when the spiral rod 52 downwardly moves, thus carrying the spinning member 51 to synchronously rotates to axially move upward. Accordingly, because the extendable rod 2 is coupled to the spinning member 51, it rotates and moves together with the spinning member 51. The mop head 4 is driven to spin by the extendable rod 3, thus producing a centrifugal force. The centrifugal force is applied to remove the water content contained in the mopping members of the mop. The removed water content is thus collected into the container 9.

When the pressing rod 3 is axially pulled upward, the spiral rod 52 is moves upwardly. Meanwhile, the unilateral bearing 53 functions and does not rotate, so that the spinning member 51, the extendable rod 2, the mop head 4, and the basket 9 do not rotate. When the pressing rod is pressed down again, the mop head 4 rotates again. In such a manner, the operation can be repeated for removing the water content from the mopping members to a desired moisture for mopping the floor.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A mop, comprising:

a spinning member, comprising a first end, a second end opposite to the first end, and a spiral hole axially configured through the spinning member from the first end to the second end of the spinning member;

a spiral rod comprising a first end and a second end, wherein the spiral rod is axially inserted through the spiral hole, and the spiral rod is further provided with a unilateral bearing sleeved over the spiral rod;

an extendable rod, being a hollow member having a first end and a second end, wherein the second end of the extendable rod is tightly coupled with the first end of the spinning member;

a mop head, coupled to the first end of the extendable rod; and a pressing rod, being a hollow member having a first end and a second end, wherein the spiral rod is sleeved inside the pressing rod, the first end of the pressing end is slidably coupled over the spinning member and the extendable rod connected with the spinning member, and the second end of the pressing rod is jointed with the second end of the spiral rod, wherein when the mop is put in a basket which is free for rotation, the pressing rod is then axially applied with a downward pressure, and the extendable rod is relatively withdrawn inside the pressing rod, the spinning member synchronously carries the extendable rod, the mop head and the basket to rotate, thus applying a centrifugal force to remove water content contained in the mop away from the basket.

2. The mop as claimed in claim 1, further comprising an elongation rod connected between the extendable rod and the mop head.

3. The mop as claimed in claim 1, wherein a fixing member is provided between the pressing rod and the extendable rod.

4. The mop as claimed in claim 3, wherein the fixing member comprises an inner sleeve and an outer sleeve, wherein the inner sleeve is disposed at the second end of the extendable rod, and the outer sleeve is disposed at the first end of the pressing rod, wherein the inner sleeve and the outer sleeve are respectively configured with corresponding coupling structures for coupling the inner sleeve with the outer sleeve together, and when the inner sleeve is coupled with the outer sleeve by the coupling structures, a relative length of the extendable rod and the pressing rod is fixed, and when the inner sleeve is not coupled with the outer sleeve by the coupling structures, the extendable rod is relatively allowed to be withdrawn inside the pressing rod.

5. The mop as claimed in claim 1, wherein a position restricting member is provided at the first end of the spiral rod for preventing the spinning member from detaching off the spiral rod.

6. The mop as claimed in claim 5, wherein the position restricting member comprises an annular plate and a pin, wherein the annular plate is positioned at the first end of the spiral rod and is positioned beneath the spinning member, and the pin is inserted through the spiral rod positioned beneath the annular plate.

7. The mop as claimed in claim 1, further comprising an anti-skidding sock having an inner cavity for accommodating the second end of the pressing rod.

8. The mop as claimed in claim 7, wherein the unilateral bearing is sleeved over the second end of the spiral rod.

9. The mop as claimed in claim 1, wherein the unilateral bearing is positioned between the spinning member and the spiral rod.

10. The mop as claimed in claim 1, wherein a stopper is sleeved over a bottom of the second end of the spiral rod, and the stopper is tightly coupled with the second end of the spiral rod.

11. The mop as claimed in claim 8, wherein a liner is provided between the anti-skidding sock and the unilateral bearing.

* * * * *